United States Patent [19]

Prusak et al.

[11] 4,436,603

[45] Mar. 13, 1984

[54] APPARATUS FOR SEPARATING A REPLICA FROM A MATRIX

[75] Inventors: John J. Prusak; Bhupendra P. Patel, both of Indianapolis, Ind.

[73] Assignee: RCA Corporation, New York, N.Y.

[21] Appl. No.: 507,531

[22] Filed: Jun. 24, 1983

[51] Int. Cl.[3] ..... C25D 17/00

[52] U.S. Cl. ..... 204/194; 204/281

[58] Field of Search ..... 204/194, 216, 281

[56] References Cited

U.S. PATENT DOCUMENTS 4,381,964 5/1983 Lock ..... 156/344

*Primary Examiner*—T. Tufariello

*Attorney, Agent, or Firm*—Birgit E. Morris; Edward J. Sites

[57] ABSTRACT

An apparatus is disclosed for separating a replica from a matrix. The apparatus consists of a rotatable lower turntable and a movable upper turntable assembly between which the replica and matrix assembly to be separated are clamped during the separation process. A tool is provided to selectively apply pressure to the outer edge of the matrix to cause the seal between the replica and the matrix to be broken and also to provide a gap between the replica and the matrix. A pair of opposing clamp members having an aperture in the jaws of the clamps is inserted into the gap between the replica and the matrix. The clamp members are advanced so as to lock the matrix to the surface of the lower turntable. A pair of upper clamp members which are mounted on the support assembly for the upper turntable are moved into position so as to engage the replica. The upper turntable assembly with the replica clamped to the surface is then drawn vertically away from the lower turntable so as to cause a controlled separation of the replica in a direction normal to the recorded surface of the matrix, thereby preventing damage to the replica and the matrix. The clamps hold the replica and matrix until released and the parts are removed by the operator.

6 Claims, 12 Drawing Figures

Fig. 5
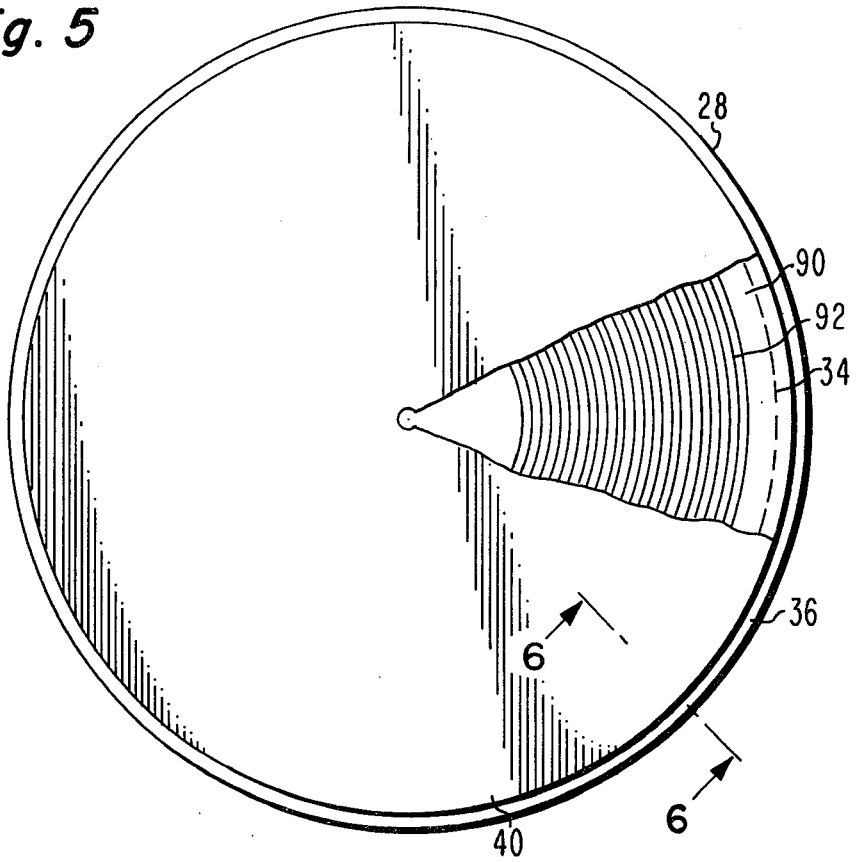
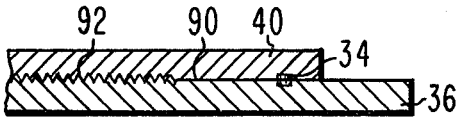
Fig. 6
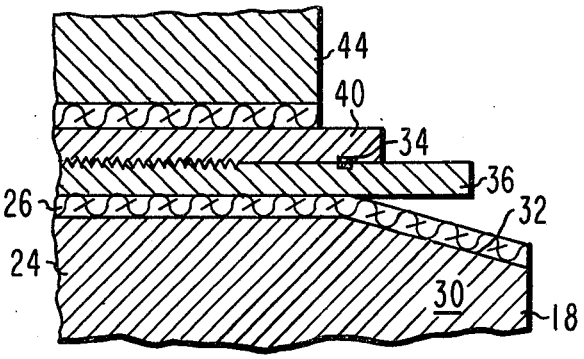
Fig. 7

APPARATUS FOR SEPARATING A REPLICA FROM A MATRIX

This invention relates to an apparatus for separating an electroformed replica from the matrix on which it is formed, and, more particularly, is concerned with the separation of molds from masters and stampers from molds in the matrixing process used in the manufacture of audio and high density information records.

BACKGROUND OF THE INVENTION

In the manufacture of molded records, a thermoplastic material is molded between a pair of flat disc shaped members referred to as stampers. The stampers used in the molding process are metal parts which have defined in their molding surface a mirror image of the surface relief pattern desired to be molded into the surface of the record. It is important that the molding surface of the stamper used to press the record be free of scratches or other surface imperfections, since these will be reproduced in the molded record and will cause defects on playback.

The stampers themselves are the end product of a multistep manufacturing process. The initial step in the process is to record the desired program information on a recording tape such as a magnetic tape. The tape is then used to drive a cutter head which cuts a surface relief pattern corresponding to the information recorded on the tape into a recording substrate.

The patterned surface of the recording substrate is then replicated by electroforming a metal, such as bright nickel, on the surface of the recording substrate. The part which is electroformed on the surface of the substrate is referred to as a master. The resulting master must be very carefully separated from the recording substrate to prevent damage to the master.

The above steps are repeated, using the master to electroform a series of parts resulting in a plurality of stampers being generated from a single master.

One area which has been found to be extremely troublesome with regard to the introduction of surface defects is the separation of the replicas from the matrixes on which the replicas are formed. One conventional method used for the separation is to manually split the replica from the matrix with a hand held knife and then physically strip the replica from the surface of the matrix. This method has many inherent disadvantages. It is not uncommon for the operators to plunge the knives used for the separation too far into the seam between the matrix and replica and scratch or otherwise damage the recorded surface of the replica, the matrix, or both parts. Even if a correct cut is made at the outer edge, the force required to separate the replica from the matrix often causes one of the parts to be bent or otherwise damaged beyond repair. A still further problem of the manual method of separation is that the parts often separate prematurely and tend to slide over the surface of each other and cause surface damage to either one or both of the parts. The manual method of separation also requires the excessive manual handling of the replicas and the matrixes during separation which inevitably results in the operator contacting the surface of the parts leaving oily deposits or the like on the surface which interfere with further matrixing processes.

Various suggestions have been made in the art to improve the separation of the replicas from matrixes. One such suggestion was made by Lock in U.S. Pat. No. 4,381,964 entitled, "Method and Apparatus for Separating a Stamper and a Mold" where it was suggested to inject a gas under pressure at the center hole between the stamper and the mold so as to force the stamper from the surface of the mold. The apparatus of the Lock invention works with reasonable success under strictly controlled laboratory conditions, but was found under production conditions to be at best marginal due to the normal production variations in the electroformed parts. In addition, the apparatus of Lock is expensive to build, operate and maintain.

Other methods and apparatus have been suggested but again with at best erratic or poor results being obtained in the separation of replicas from matrixes.

It would be desirable thus to have an apparatus for separating replicas from the matrixes on which they are formed which would be inexpensive to construct, relatively simple to operate and which would provide reliable results in separating the replicas from matrixes without causing damage to either the matrixes or the replicas.

SUMMARY OF THE INVENTION

An apparatus is disclosed for separating a replica from a matrix. The apparatus consists of a rotatable lower turntable and a movable upper turntable assembly. The replica and the matrix to be separated are clamped between the upper and lower turntables during the separation process. A tool is used to selectively apply pressure to the outer edge of the matrix to cause the seal between the replica and the matrix to be broken and also to provide a gap between the replica and the matrix. A pair of opposing lower clamp members having an aperture in the jaws of the clamps is inserted into the gap formed between the replica and the matrix. The clamp members are advanced so as to lock the matrix to the surface of the lower turntable. A pair of upper clamp members which are mounted on the support assembly for the upper turntable are moved into position so as to engage the replica. The upper turntable assembly with the replica clamped to the surface thereof is then drawn vertically away from the lower turntable so as to cause a controlled separation of the replica in a direction normal to the recorded surface of the matrix, thereby preventing damage to the replica and the matrix. The clamps hold the replica and matrix until released and the parts are removed by the operator.

BRIEF DESCRIPTION OF THE DRAWING

FIG. 5 is a top plan view in partial cross section of a replica formed on the surface of a matrix.

FIG. 6 is a cross-sectional illustration taken as indicated by the line and arrow 6 of FIG. 5.

FIG. 7 is a cross-sectional illustration of the edge portion of the matrix illustrated in FIG. 6 which is gripped between the upper turntable and lower turntable of the apparatus of FIG. 1.

DETAILED DESCRIPTION OF THE PREFERRED EMBODIMENT

Figure 1:
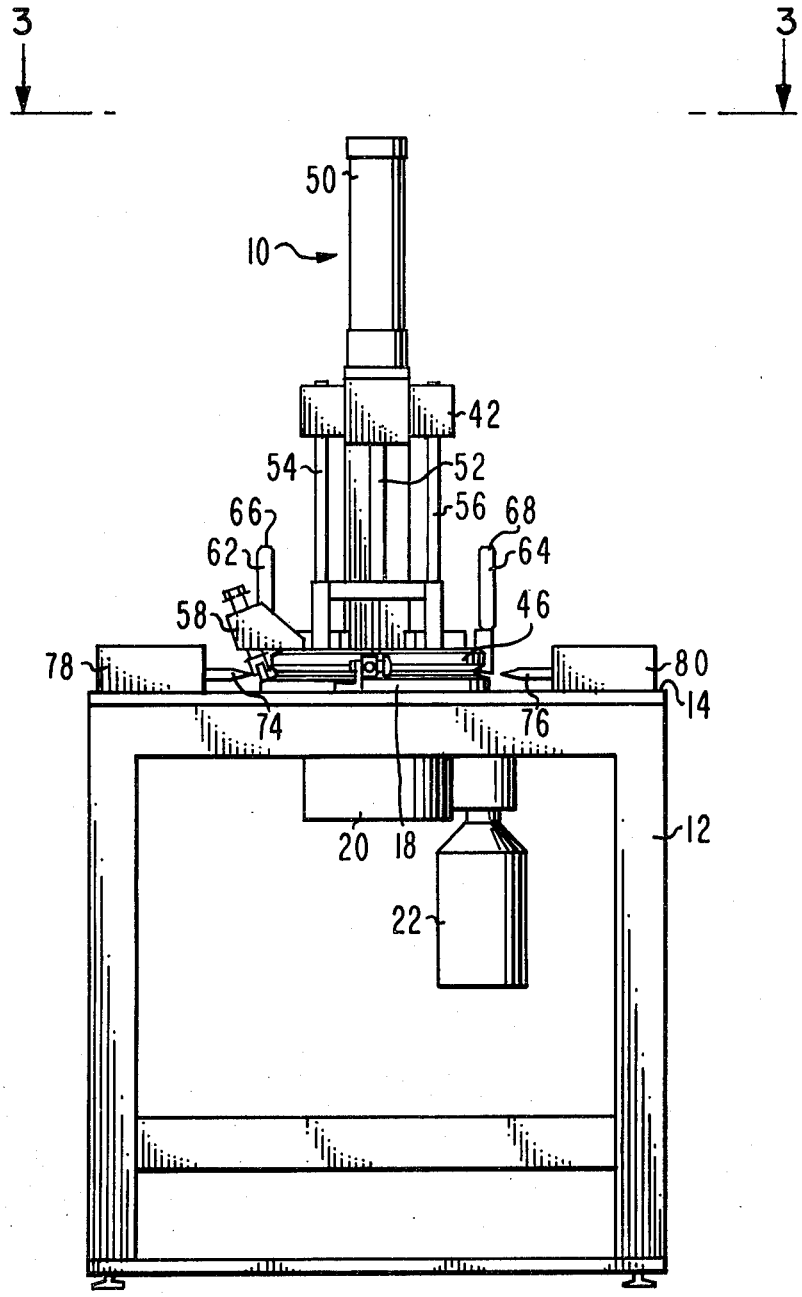
FIG. 1 is a front view of the apparatus of the present invention.
Figure 2:
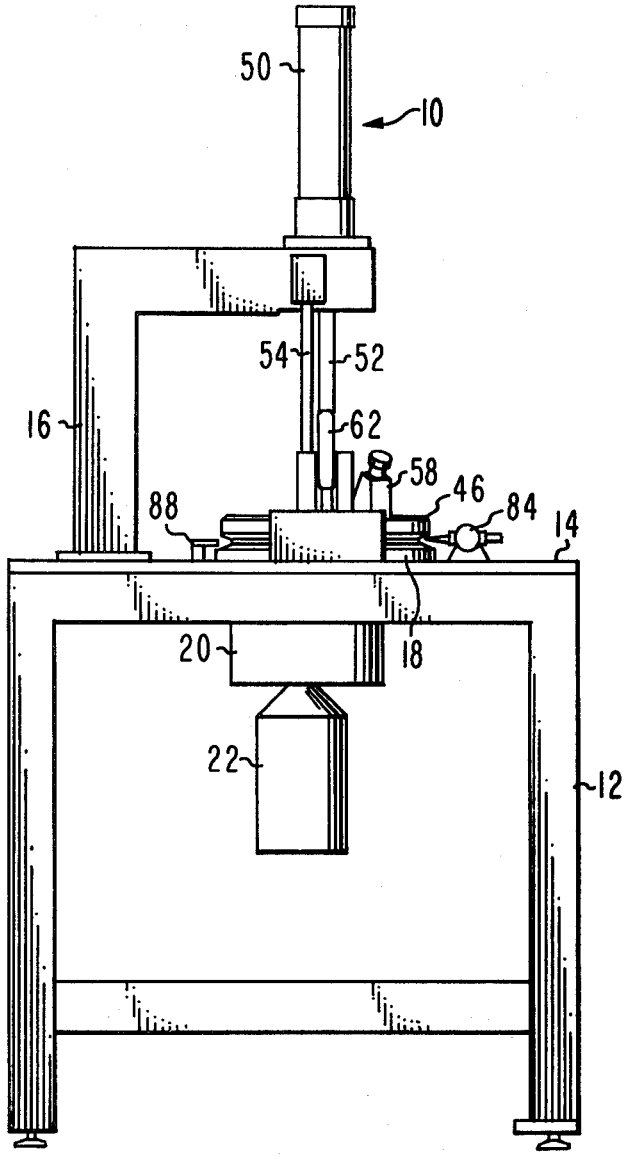
FIG. 2 is a side view of the apparatus of the present invention.

The apparatus of this invention 10 has a support base 12 on which certain of the components of the apparatus 10 are mounted. As illustrated in the Figures, particularly in FIGS. 1 and 2, the base 12 is comprised of a deck portion 14 and an upper support arm 16 which is formed as an integral part of the base 12. Mounted on the deck 14 is a lower turntable 18. The turntable 18 is connected to a gear drive 20 which in turn is connected to an electric motor 22. When the electric motor 22 is activated, it drives the gear drive 20 which in turn rotates the lower turntable 18.

The lower turntable 18 is flat except for the outer edge and is made of a metal, such as machine steel, hardened aluminum or the like. The upper surface 24 of the lower turntable 18 is preferably covered with a resilient material such as a rubber or a cloth layer 26.

Figure 9:
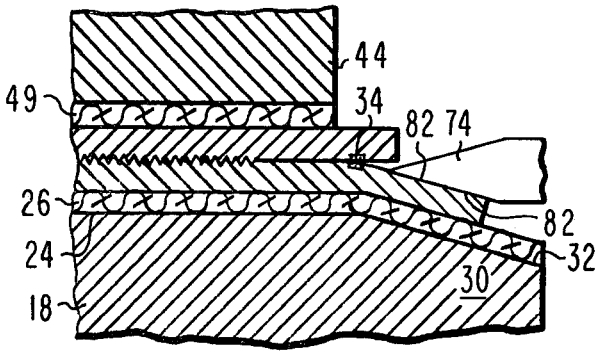
FIG. 9 is a cross-sectional illustration showing the matrix locked in position against the lower turntable by the lower clamp of the apparatus of FIG. 1.
Figure 10:
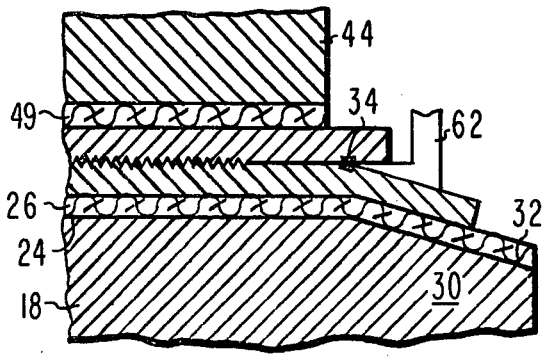
FIG. 10 is a cross-sectional illustration of the replica gripped by the upper clamp of the apparatus of FIG. 1.
Figure 11:
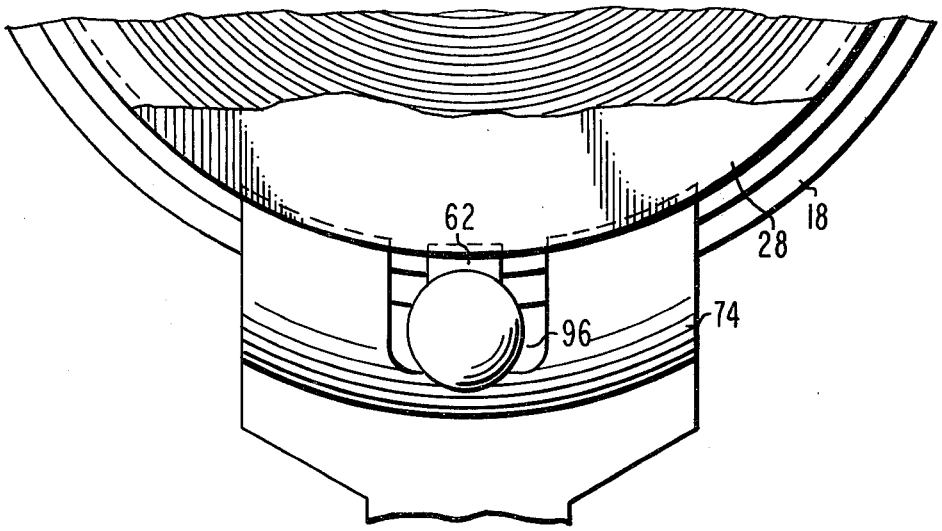
FIG. 11 is an illustration in partial cross section taken from a top portion of the apparatus of the present invention illustrated in FIG. 1 showing the relationship of the matrix, replica, upper turntable, lower turntable and upper and lower clamps.
Figure 12:
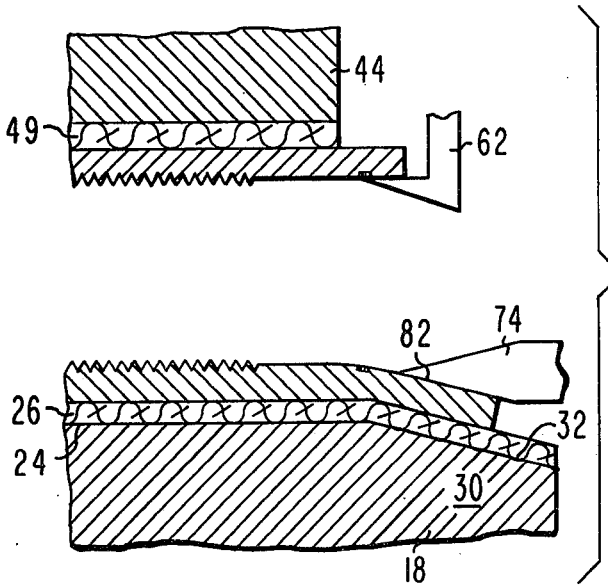
FIG. 12 is a composite cross-sectional view schematically illustrating the separation process of the present invention.

An important feature of the lower turntable 18 is that it has a diameter which is at least as large as the diameter of the matrix replica assembly 28 which is to be separated on the apparatus 10 (see FIGS. 7 and 11). Furthermore, as best seen in FIGS. 7–12 the outer diameter portion 30 of the lower turntable 18 is formed with a bevelled edge 32. The bevelled edge 32 starts at about the area where the sealing strip 34 is formed between the matrix 36 and the replica 40. The angle of the bevelled edge 32 is highly important for reasons which will become clearer hereinafter. For the time being, however, it should be noted that the angle of the bevelled edge 32 must be sufficient to allow the bond between the replica 40 and the matrix 36 at the sealing strip 34 to be broken, but must not be so large as to cause the matrix 36 to be permanently deformed at the outer edge when pressed down to the bevelled edge 32. It has been found in practice that a bevel angle between, for example, 10° and 15°, is highly satisfactory for this purpose with about 12° being optimum.

Figure 4:
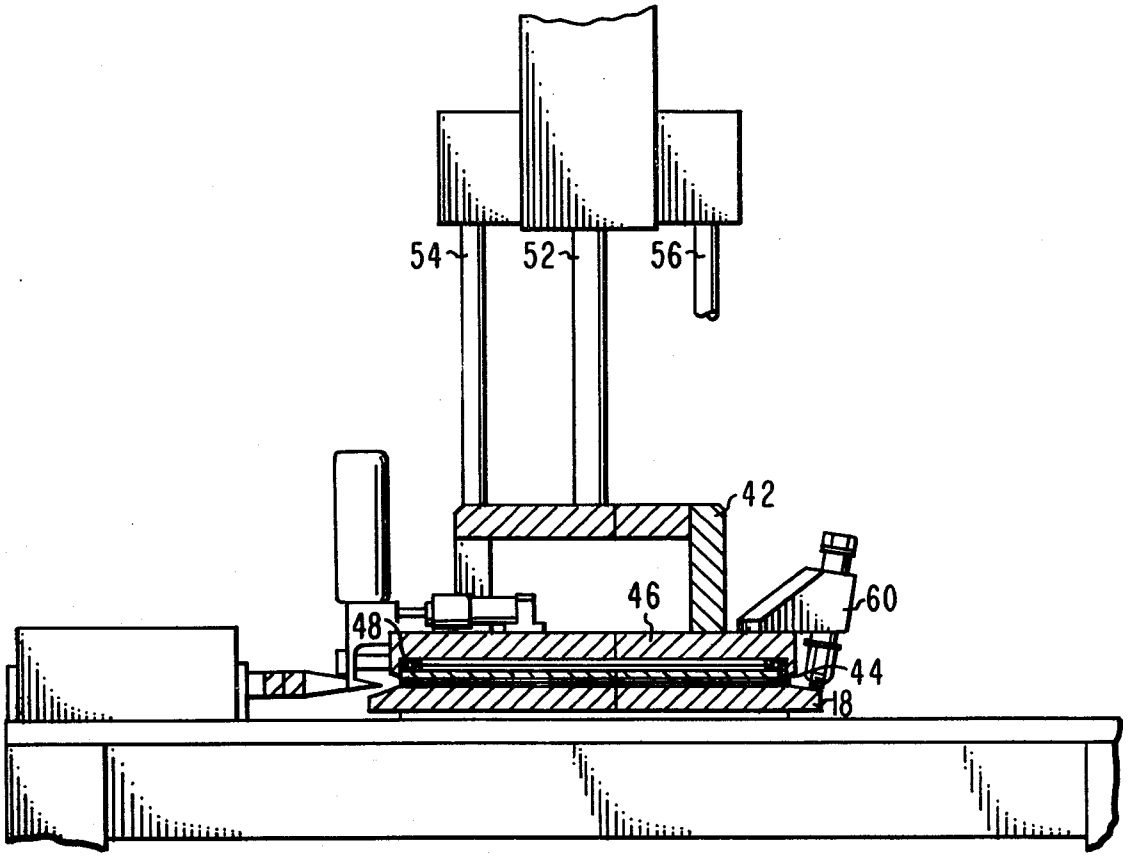
FIG. 4 is a cross-sectional illustration taken as indicated by the line and arrow 4 of FIG. 3.

As best seen in FIG. 4, mounted above the lower turntable 18 and in vertical alignment with the lower turntable 18 there is a vertically movable upper turntable assembly 42. The upper turntable assembly 42 includes an upper turntable 44 which is mounted in a holder 46. The upper turntable 44 is permitted to revolve freely in the holder 46 by use of a ball bearing race 48 mounted in the holder 46. As will be pointed out below, the upper turntable revolves independently of the holder 46 and is adapted to be frictionally driven by the lower turntable 18. The upper turntable 44 has a flat surface and a diameter which is less than the diameter of the replica 40 so that a portion of the outer diameter of the replica 40 extends beyond the edge of the upper turntable. Like the lower turntable 18, the surface of the upper turntable 44 has its surface covered with a resilient rubber or cloth 49.

The upper turntable assembly 42 is secured to the stationary upper arm support 16 of the base 12. Mounted directly to the upper arm support 16 is the body of a double action air cylinder 50. The drive rod 52 of the air cylinder 50 when activated is driven in the downward direction forcing the upper turntable 44 into pressure engagement with the lower turntable 18 so as to clamp the assembly 28 in place. In the reverse upward direction, the air cylinder 50 when activated applies an upward force to assist in the separation of the replica 40 from the matrix 36. The holder 46 which carries the upper turntable 44 is guided by guide rods 54, 56 to insure perpendicular operation relative to the surface of the lower turntable 18 so as to prevent distortion of the grooves of the replica 40 and the matrix 36.

The upper turntable assembly 42 also has mounted on the holder portion 46 a pair of opposing pressure wheel assemblies 58, 60 which are aligned so as to engage the outer diameter of the matrix 36. Adjacent the pressure wheel assembly 58, 60 are a pair of upper clamps 62, 64 which can be operated by hand with the handles 66, 68 or with the air cylinders 70, 72.

The deck portion 14, in addition to having the lower turntable 18 mounted thereon, has a number of other components of the apparatus 10 mounted thereon. As can be best seen in FIG. 3, there is a pair of opposing bottom clamps 74, 76 which are adapted to move towards or away from the bottom turntable 18 by the air cylinders 78, 80. The bottom clamps 74, 76 are made with wedge shaped leading edges 82. The angle on the wedge shaped leading edges 82 is the same as the angle of the bevelled edge 32 on the lower turntable 18 so that when the clamps 74, 76 are aligned with the lower turntable 18 and are advanced inwardly, the clamps 74, 76 will form a locking seal with the lower turntable and a matrix on its surface as shown in FIG. 9.

Figure 3:
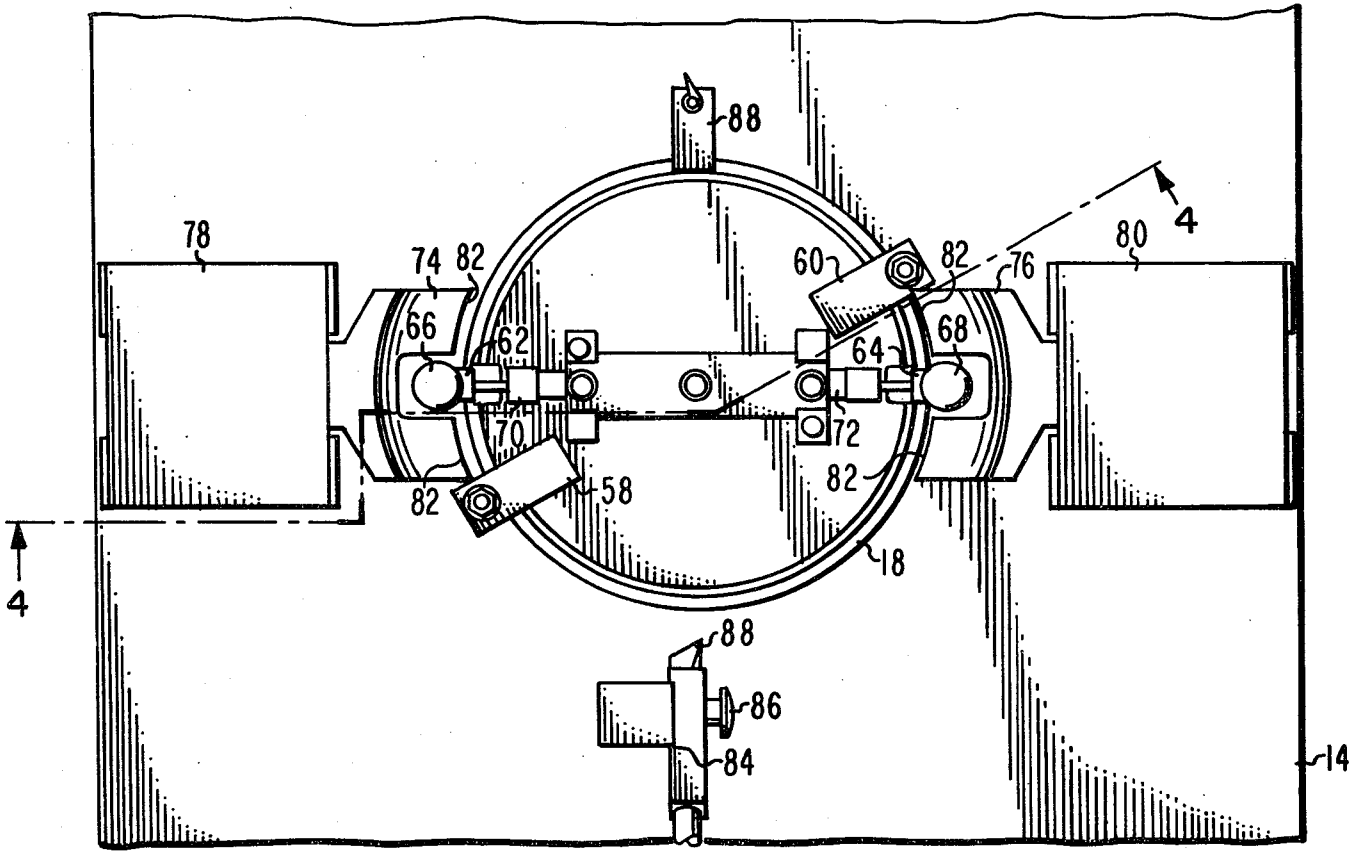
FIG. 3 is a top view of the apparatus of the present invention taken as indicated by the line and arrow 3 on FIG. 1.

As best seen in FIG. 3, a movable knife assembly 84 is likewise mounted on the deck 14 of the base 12. The knife assembly 84 is optional and is only used to split assemblies of matrixes and replicas 28 in the event that an unusually strong bond which will not break is formed between the replica 40 and the matrix 36. The knife assembly 84 includes lock means 86 to limit the maximum penetration of the knife 88 so as not to damage either the replica 40 or the matrix 36.

On the deck 14 of the support 12 an adjustable stop means 88 is also provided for assistance in positioning the assembly of the replica and matrix 28 on the lower turntable 18. The exact position of the stop means 88 can be adjusted so as to accommodate assemblies of matrixes and replicas 28 which have either a master or a mold as the matrix part, that is to accommodate assemblies 28 of slightly different diameters.

In operation of the apparatus 10 of this invention, the first step is to position all the components that comprise the apparatus 10 in their starting position. The double acting cylinder 50 is activated so as to raise the holder 46 and the upper turntable 44 into an upper position separated from the lower turntable. The upper clamps 62, 64 are released and positioned in their outward locations. The lower wedge shaped clamps 74, 76 are likewise withdrawn by their respective air cylinders 78, 80 to their outboard position. The stop means 88 is set at the proper position depending on the type of assembly 28 to be separated. The knife assembly 84 is likewise adjusted so as to have the knife blade 88 in its most withdrawn position.

The stamper assembly 28 to be separated is centered on the lower turntable 18 with the matrix side in contact with surface 26 of the lower turntable 18. As can be seen from FIG. 5, the matrix 36 is larger in diameter than the replica 40 so that the outer diameter of the matrix 36 is exposed. Between the matrix 36 and the replica 40 there is formed a sealing strip 36, usually by deliberately texturizing the area about the outer diameter of the matrix on which the replica 40 is formed. By reference to FIG. 5, it can be seen that in the assembly 28, there is an unrecorded area 90 and a recorded area 92. It is important that no damage occurs to the recorded area 92 in the separation of the matrix 36 from the replica 40, as even a single scratch in the recorded area 92 can destroy both the replica 40 and the matrix 36.

Figure 8:
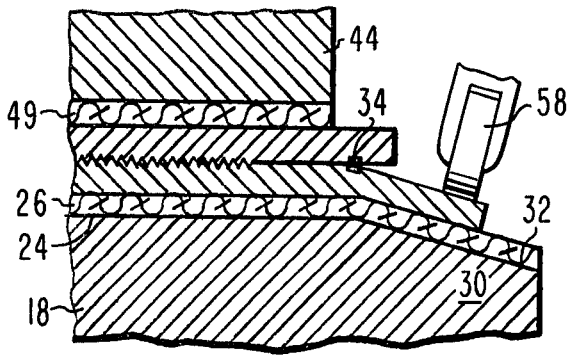
FIG. 8 is a cross-sectional illustration similar to that of FIG. 7 but wherein the matrix is separated at the outer diameter from the replica by the pressure applying means.

As can be seen in FIG. 7, the exposed edge of the matrix 36 extends over the bevelled edge 32 of the lower turntable 18 with the sealing strips 34 at about the pivot point. The upper cylinder 50 is activated to bring the upper turntable 44 into pressure contact with the assembly 28 of the matrix 40 and the replica 36. As shown in FIG. 8, the wheel members 58, 60 engage the outer diameter of the matrixing assembly 28 applying a force to the outer diameter sufficient to urge it downward and onto the bevelled edge 32 of the lower turntable 18. The exposed portion of the replica 40 being substantially shorter remains in place because it is relatively rigid due to its shorter length. The bond of the sealing strip 34 will be broken by the pressure of the wheel members 58, 60 on the matrix 36. To insure complete disengagement of the seal 34, the lower turntable 18 with the upper turntable 44 in pressure engagement is revolved several complete revolutions. If there is still some residual bonding, even after several revolutions, the knife 88 of the knife assembly 84 can be inserted between the replica 40 and the matrix 36. This expedient, however, is not normally required and should not normally be used as it increases the possibility of damage to the matrix 36 and replica 40.

The rotation of the lower turntable 18 is discontinued when the bond formed by the seal strip 34 has been completely broken. At this point, the pressure wheel assembly 58, 60 will be holding the matrix against the bevelled edge 32 of the lower turntable 18 with a separation 94 between the replica 36 and the matrix 40. To complete the separation, the air cylinders 78, 80 are activated causing the lower clamp members 74, 76 to move inwardly until they enter the separation 94 between the matrix 36 and replica 40 and thereafter engage the matrix 36 on the bevelled edge 32. The clamps 74, 76 having engaged the matrix 36 on the bevelled edge will hold the matrix 36 against the bevelled edge 32 of the lower turntable 18. The upper clamp member 62, 64 are then moved into position to engage the outer exposed edge of the replica 40 as shown in FIG. 10. The upper clamp 62, 64 enter the separation 94 between the matrix 36 and the replica 40 through an aperture 96 formed in the lower clamp members 74, 76. The upper clamp can be operated manually with the handle 64, 66 or can be activated by air cylinders 70, 72.

Once both the matrix 40 and the replica 36 are separated by the wheel assembly 58, 60 at the outer edge and the clamps 62, 64, 74, 76 are in place, the double acting air cylinder 50 is activated by reversing the action to cause the upper turntable 44 with the replica of 40 attached to the surface thereof, to separate from the lower turntable 18 with the matrix 40 clamped to its surface.

Once separated, the individual clamps 74, 76, 62, 64 are released and the individual parts are readily removed from the apparatus 10.

Because of the control of the separation process and particularly because of the vertical separation of the matrix 36 and replica 40 without the need of manual intervention of the operator except to load and remove the parts, it has been found that the separation process is simpler and more effective with the result that there is no substantial damage to the matrix 36 or the replica 40.

What is claimed is:

1. An apparatus for separating a replica of a first diameter from a surface of a matrix of a larger second diameter wherein the replica is secured to the matrix by a circumferential seal means of a predetermined diameter positioned inwardly and adjacent to the first diameter, said apparatus comprising in combination:

(a) a lower turntable rotatably mounted on a support means, said lower turntable having an outer diameter at least as large as said second diameter and having a flat central portion of a diameter of about said predetermined diameter of the seal means with the outer circumferential portion of the lower turntable being bevelled from the edge of the flat portion of the outer diameter of the lower turntable at a predetermined angle sufficient so that a matrix clamped on the flat portion can be flexed to the surface of the bevel without being permanently distorted;

(b) means for rotating said lower turntable;

(c) an upper turntable assembly comprised of an upper turntable having a flat surface and a diameter less than said first diameter; holding means for receiving and holding said upper turntable and means associated with said holding means for permitting rotation of said turntable independent of said holding means;

(d) means for raising and lowering the upper turntable means vertically in alignment with said lower turntable and for applying upward and downward force;

(e) pressure applying means for forcing the outer diameter of a matrix clamped between the upper and lower turntables into contact with the bevelled edge of the lower turntable;

(f) lower clamp means mounted on said support means in an opposing relationship to the lower turntable, said lower clamp means having the leading portions thereof bevelled to about said predetermined angle;

(g) means for advancing and retracting said lower clamp means toward and away from the lower turntable with the bevelled leading portion of the lower clamp means being aligned so as to engage in locking contact the bevelled edge of the lower turntable; and (h) movable upper clamp means for gripping a portion of a replica extending behind the outer diameter of the upper turntable.

2. The apparatus according to claim 1 which further includes knife means for separating the seal means between the replica and matrix.

3. The apparatus according to claim 1 wherein the angle of the bevel on the lower turntable is between about 10° and 15°.

4. The apparatus according to claim 1 wherein the angle of the bevel in the lower turntable is about 12°.

5. The apparatus according to claim 1 wherein the lower clamp means is of a fork like configuration having first and second prongs separated by a predetermined width space and wherein said upper clamp means has a leading edge portion of a width less than said predetermined width and said upper clamp means is aligned with the lower clamp means so that the leading edge can enter the space in the lower clamp means to engage a replica.

6. The apparatus of claim 1 wherein the means for raising and lowering the upper turntable is a double action air cylinder.

* * * * *